US011703812B2

(12) United States Patent
Hori et al.

(10) Patent No.: US 11,703,812 B2
(45) Date of Patent: Jul. 18, 2023

(54) TIMEPIECE, CONTROL METHOD FOR CHANGE OF TIME, AND STORAGE MEDIUM

(71) Applicant: CASIO COMPUTER CO., LTD., Tokyo (JP)

(72) Inventors: Hayato Hori, Kokubunji (JP); Shuto Oikawa, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 958 days.

(21) Appl. No.: 16/585,039

(22) Filed: Sep. 27, 2019

(65) Prior Publication Data

US 2020/0103832 A1 Apr. 2, 2020

(30) Foreign Application Priority Data

Oct. 1, 2018 (JP) ..... 2018-186773

(51) Int. Cl.
*G04R 20/04* (2013.01)
*G04R 20/28* (2013.01)

(52) U.S. Cl.
CPC ..... *G04R 20/04* (2013.01); *G04R 20/28* (2013.01)

(58) Field of Classification Search
CPC ..... G04R 20/28; G04R 20/04
See application file for complete search history.

(56) References Cited

U.S. PATENT DOCUMENTS

| | | | | |
|---|---|---|---|---|
| 9,261,861 | B2 * | 2/2016 | Hasegawa | G04R 20/02 |
| 9,869,977 | B2 * | 1/2018 | Hasegawa | G04R 20/04 |
| 10,459,409 | B2 * | 10/2019 | Hasegawa | G04R 20/02 |
| 2007/0140064 | A1 * | 6/2007 | Fujisawa | G04R 20/10 368/47 |

(Continued)

FOREIGN PATENT DOCUMENTS

| | | | |
|---|---|---|---|
| CN | 103092068 | A | 5/2013 |
| CN | 108227473 | A | 6/2018 |

(Continued)

OTHER PUBLICATIONS

First Office Action dated Jan. 21, 2021 received in Chinese Patent Application No. CN 201910881200.5 together with an English language translation.

(Continued)

*Primary Examiner* — Sean Kayes
(74) *Attorney, Agent, or Firm* — Scully, Scott, Murphy & Presser, P.C.

(57) ABSTRACT

A timepiece includes a clock circuit, a signal receiver configured to receive signals including time information, a processor configured to control a changing operation of changing a current time measured by the clock circuit based on the time information obtained from the signal receiver and controls a presenting operation of whether or not the changing operation is successful. The processor controls the changing operation based on a first flag indicating whether or not the signal receiver successfully receives the time information. The processor controls the presenting operation based on a second flag indicating whether or not the changing operation is successful within a predetermined period of time.

13 Claims, 5 Drawing Sheets

(56) References Cited

U.S. PATENT DOCUMENTS

| | | | | |
|---|---|---|---|---|
| 2009/0129206 | A1* | 5/2009 | Baba | G04R 20/04 368/14 |
| 2012/0188854 | A1* | 7/2012 | Baba | G04G 21/00 368/47 |
| 2015/0185706 | A1* | 7/2015 | Hasegawa | G04R 20/04 368/47 |
| 2015/0198928 | A1* | 7/2015 | Hasegawa | G04R 20/04 368/10 |
| 2018/0173170 | A1 | 6/2018 | Hasegawa | |

FOREIGN PATENT DOCUMENTS

| | | | |
|---|---|---|---|
| JP | H10-253779 | A | 9/1998 |
| JP | 2004-198290 | A | 7/2004 |
| JP | 2004-279107 | A | 10/2004 |
| JP | 2011-047727 | A | 3/2011 |
| JP | 2015125047 | A | 7/2015 |
| JP | 2015132537 | A | 7/2015 |
| JP | 2018151267 | A | 9/2018 |

OTHER PUBLICATIONS

Notice of Reasons for Refusal dated Jun. 28, 2022 received in Japanese Patent Application No. JP 2018-186773.

* cited by examiner

TIMEPIECE, CONTROL METHOD FOR CHANGE OF TIME, AND STORAGE MEDIUM

CROSS-REFERENCE TO RELATED APPLICATIONS

This application is based upon and claims the benefit of priority from prior Japanese Patent Application No. 2018-186773, filed Oct. 1, 2018, the entire contents of which are incorporated herein by reference.

BACKGROUND

1. Technical Field

The technical field relates to a timepiece, a control method for a change of a time, and a storage medium.

2. Description of Related Art

A timepiece that can correct a time with the use of external radio waves, such as standard frequency and time signal waves and radio waves from a global positioning system (GPS) satellite, is known. For example, Jpn. Pat. Appln. KOKAI Publication No. 10-253779 discloses a timepiece that corrects a time to a time of a current location through receipt of radio waves transmitted from a satellite.

There are various timepieces provided with an indicator on a dial for the purpose of indicating whether or not time correction is successful. In such a timepiece, a second hand points at an indicator "YES" if time correction is successful, and an indicator "NO" if time correction fails. To indicate such information with a second hand, it is necessary to correctly display, to a user, information regarding whether or not immediately prior time correction has been successfully performed.

SUMMARY

In one embodiment, a timepiece, a control method for the change of a time, and a storage medium are disclosed.

One embodiment includes the following configuration: a timepiece including a clock circuit; a signal receiver configured to receive signals including time information; a processor configured to control a changing operation of changing a current time measured by the clock circuit based on the time information obtained from the signal receiver, and controls a presenting operation of whether or not the changing operation is successful; wherein the processor controls the changing operation based on a first flag indicating whether or not the signal receiver successfully receives the time information, and controls the presenting operation based on a second flag indicating whether or not the changing operation is successful within a predetermined period of time.

DETAILED DESCRIPTION

Embodiments will be described below with reference to the drawings. Conventionally, an internal flag for indicating successful time correction has been used to present success/failure of time correction in a timepiece. This internal flag is conventionally set to "false" at zero hour; in contrast, in the present embodiment, a new flag differing from such an internal flag is used to present success/failure of time correction in a timepiece. Reliability of the presentation, to a user, of success/failure of time correction before and after a date changes is thereby improved.

Figure 1:
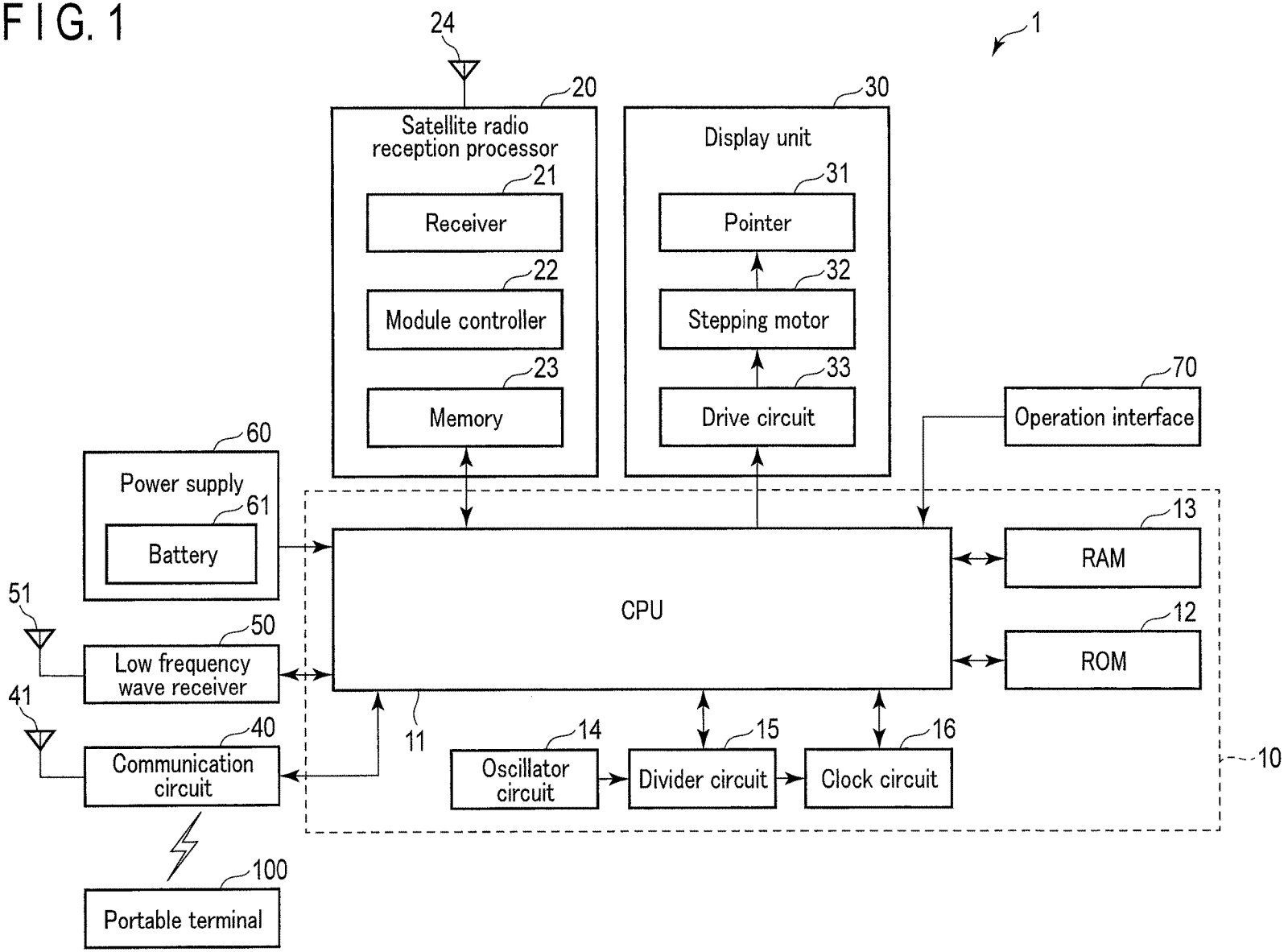
FIG. 1 is a block diagram showing a configuration example of a timepiece according to an embodiment.

FIG. 1 is a block diagram showing a configuration example of a timepiece 1 according to an embodiment. The timepiece 1 may be a watch worn by a user such as a wristwatch, or a pocket watch. The timepiece 1 includes a microcomputer 10, a satellite radio reception processor 20, a display unit 30, a communication circuit 40, a low frequency wave receiver 50, a power supply 60, and an operation interface 70.

The microcomputer 10 controls an entire operation of the timepiece 1. The microcomputer 10 includes, for example, a central processing unit (CPU) 11, a read only memory (ROM) 12, a random access memory (RAM) 13, an oscillator circuit 14, a divider circuit 15, and a clock circuit 16. The control operation of the timepiece 1 by the microcomputer 10 includes a regular operation of displaying a date and time, various operations for correction of time (which will be later described), operations in accordance with the functions of the timepiece 1, for example an alarm notification function, a timer function, and a stopwatch function.

The CPU 11 is a processor that performs various types of computation processing, and performs control operations for individual parts of the timepiece 1. The ROM 12 is for example a mask ROM, and stores programs to cause the CPU 11 to execute the control operations, and initial setting data. The ROM 12 may have a non-volatile memory, such as a flash memory capable of rewriting and updating data, in addition to or instead of a mask ROM. The RAM 13 provides a working memory for the CPU 11, and data is temporarily stored therein. The RAM 13 stores a time-zone setting for displaying and using a current date and time in an area of the world to which a current location is set. The RAM 13 stores a local time setting including a daylight saving time (DST) setting. Based on this local time setting, the CPU 11 is capable of converting a date and time measured by the clock circuit 16 into a local time of a home city or other city in a different time zone, and outputting the converted date and time.

The RAM 13 stores a reception success flag indicating success/failure of the following: a receipt of a standard radio wave; a receipt of radio waves from a GPS satellite (will be later described); and a Bluetooth (registered trademark) communication with a portable terminal 100. The reception success flag is a binary flag indicating whether or not a receipt of data of a time (time signal) obtained through a standard radio wave, radio waves from a GPS satellite (GPS satellite radio waves), or a Bluetooth communication with a portable terminal 100, is successful.

In the present embodiment, as a reception success flag, three flags are prepared: a standard radio wave reception success flag, a GPS satellite radio wave reception success flag, and a Bluetooth reception success flag. The standard wave reception success flag is a flag indicating whether or not the low frequency wave receiver 50 successfully receives data of time through a standard radio wave. The GPS satellite radio wave reception success flag is a flag indicating whether or not the receiver 21 of the satellite radio reception processor 20 successfully receives data of time through a GPS satellite radio wave. The Bluetooth reception success flag is a flag indicating whether or not the communication circuit 40 successfully receives data of time through a Bluetooth communication with a portable terminal 100, which is an external device.

The RAM 13 stores and retains both a YN hand counter and a timer (which will be later described). Herein, "Y" of the YN hand represents "YES", and "N" represents "NO". The YN hand counter functions as a flag for correctly presenting to a user whether or not time correction is successful.

The oscillator circuit 14 generates and outputs a signal of a predetermined frequency. For the signal generation, a crystal oscillator is used, for example. The crystal oscillator may be externally added to the microcomputer 10.

The divider circuit 15 outputs a divided signal obtained by dividing a frequency signal from the oscillator circuit 14, with a preset oscillation ratio. The setting of the oscillation ratio may be changed by the CPU 11.

The clock circuit 16 measures and retains a current date and time through measuring a divided signal of a predetermined frequency input from the divider circuit 15. The current date and time measured by the clock circuit 16 may include a handful of errors. The CPU 11 corrects a current date and time measured by the clock circuit 16 based on information of accurate current date and time obtained from the satellite radio reception processor 20, the communication circuit 40, or the low frequency wave receiver 50. In other words, the CPU 11 can correct a time.

The satellite radio reception processor 20 performs an operation of receiving and processing a transmit radio wave from a positioning satellite of a satellite positioning system such as a GPS. The satellite radio reception processor 20 obtains date and time information, namely time information and date information, and current location information, and outputs to the CPU 11 the information requested by the CPU 11 in a predetermined format. The satellite radio reception processor 20 includes a receiver 21, a module controller 22, a memory 23, and an antenna 24.

The receiver 21 receives and detects a transmit radio wave from a positioning satellite which is a reception target, and performs acquisition processing to identify the positioning satellite and a phase of a transmit signal. The receiver 21 tracks the transmit radio wave from the positioning satellite based on the acquired identification information and phase of the positioning satellite, and continuously demodulates the transmit signal, for example a navigation message, and obtains the same.

The module controller 22 includes a processor such as a CPU, and performs various controls relating to the operation of the satellite radio reception processor 20. The module controller 22 obtains necessary information based on an extracted signal, and identifies a current date and time, and calculates a current location. In other words, the module controller 22 performs positioning.

The memory 23 stores various setting data and received information, and programs relating to the control performed by the module controller 22 in the satellite radio reception processor 20. The various setting data includes, for example, format data of a navigation message of each positioning satellite and criterion data for determining a receive level.

The display unit 30 displays various information based on the control of the CPU 11. The display unit 30 includes a hand 31 provided rotatably, a stepping motor 32 that rotates the hand 31, and a drive circuit 33 for the stepping motor 32. The display unit 30 may display a time, etc. by a digital display screen such as a liquid crystal display (LCD) instead of, or in addition to, the hand 31.

Figure 2:
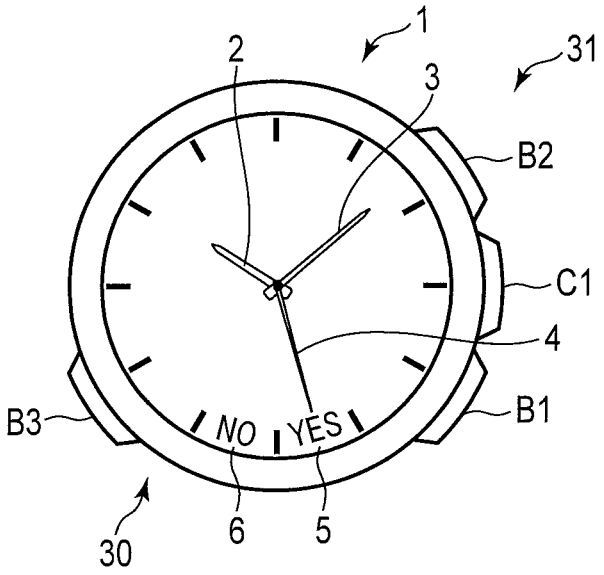
FIG. 2 is an external view of an example of a display unit of the timepiece according to the embodiment.

FIG. 2 is an external view of an example of the display unit 30 of the timepiece 1. The display unit 30 includes an hour hand 2, a minute hand 3, and a second hand 4 on, for example, a dial, as the hand 31. The hour hand 2, minute hand 3, and second hand 4 respectively point to hour, minute, and second of the timepiece when a date and time is displayed. The second hand 4 also displays various statuses by pointing out an indicator provided on the dial. FIG. 2 shows a first indicator 5, which is "YES", indicating that time correction has been successful, and a second indicator 6, which is "NO", indicating that time correction has failed. The indicators 5 and 6 are used to present success/failure of time correction to a user at user's assigned timing.

On the side surface of the body of the timepiece 1, press button switches B1, B2, and B3, and a crown C1 are provided, for example. Various functions are allocated to the press button switches B1, B2, and B3, and the crown C1. An operation signal is generated and output by pressing the press button switches B1, B2, and B3. An operation signal is also generated and output by pulling, rotating, or pressing the crown C1. The crown C1 can be pulled out at two stages, for example.

The communication circuit 40 performs various operations for communications with the use of the antenna 41, based on the control of the CPU 11. For example, the communication circuit 40 performs various operations for achieving a communication with an external device under Bluetooth, which is a short-distance wireless communication standard. An external electronic device is the portable terminal 100, for example. The communication circuit 40 performs a control operation based on a predetermined communication standard. The communication circuit 40 demodulates and obtains communication data directed to the timepiece 1, and outputs the same to the CPU 11. The communication circuit 40 modulates communication data directed to an external electronic device targeted for communication, for example the portable terminal 100, and outputs the communication data as a communication radio wave.

The low frequency wave receiver 50 receives and demodulates a standard radio wave that transmits a signal (time code) of date and time information, including time information and date information, at a low frequency band via the antenna 51. The time code, which is data of a date and time of a present minute encoded at a cycle of one minute, is transmitted. The timepiece 1 obtains an accurate date and time through checking matches between results of multiple receipts. As a standard radio wave, JJY (registered trademark) in Japan, WWVB in the United States, MSF in the United Kingdom, and DCF77 in Germany are widely used.

The satellite radio reception processor 20 and the low frequency wave receiver 50 are radio wave receivers that receive radio waves (for example, a GPS satellite radio wave or a standard radio wave) for transmitting signals that include time information. The satellite radio reception processor 20, the communication circuit 40, and the low frequency wave receiver 50 are signal receivers that receive signals including time information.

The power supply 60 supplies power required for operations to each part of the timepiece 1. The power supply 60 supplies power, which is output from the battery 61, at an operating voltage of each portion. If a required operating voltage differs from part to part of the timepiece 1, the power supply 60 performs voltage conversion using a regulator to output power at the required operating voltage. The battery 61 may be a solar panel that generates electric power from entered light or a secondary battery that stores generated electric power. As the battery 61, a dry cell or a battery charger may be detachably provided.

The operation interface 70 accepts an external input operation, such as a user's operation. The operation interface 70 includes, for example, the press button switches B1, B2, and B3, and the crown C1 shown in FIG. 2. The operation interface 70 outputs, to the CPU 11, an operation signal in accordance with an operation, such as an operation of pressing the press button switches B1, B2, and B3, an operation of pulling, rotating, or pressing the crown C1.

Figure 3:
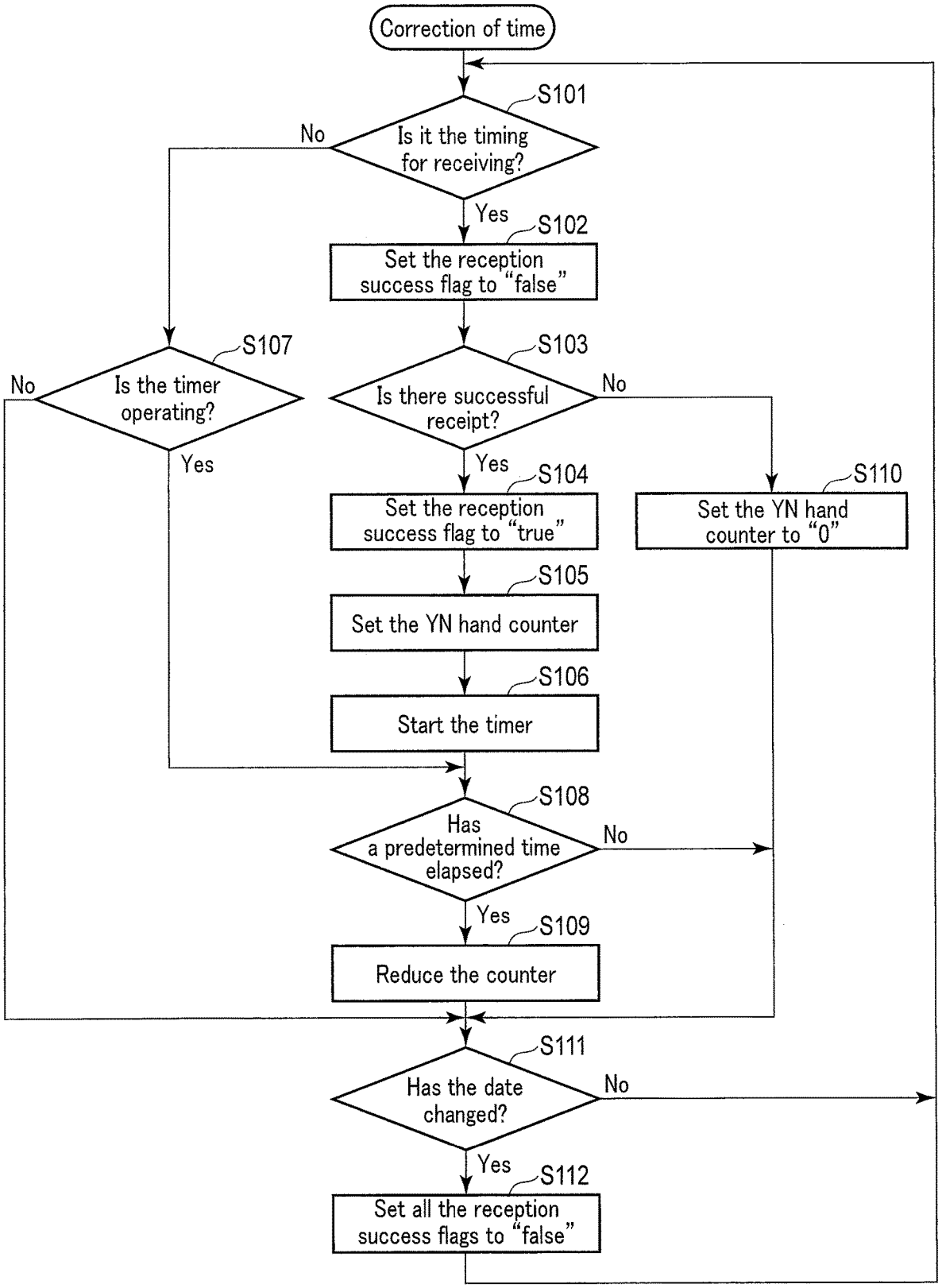
FIG. 3 is a flow chart showing an example of internal processing performed when a time is corrected in the timepiece of the embodiment.

Internal processing when a time is corrected in the timepiece 1 having the above-described configuration will be described. FIG. 3 is a flow chart showing an example of internal processing for correction of time in the timepiece 1 of the present embodiment.

In step S101, the CPU 11 determines whether or not it is the timing to receive a radio wave, etc. Herein, the timing for receiving is the time for receiving a standard radio wave, a GPS satellite radio wave, or a Bluetooth communication, and may be the timing to receive any of them. Whether or not it is the timing to receive is determined based on a preset time, and whether or not a reception success flag is set at the said time. The preset time may be fixed timing, for example every 6 hours, namely four times a day. For example, if a reception success flag is not set to "true" at the preset time, the CPU 11 determines that it is the timing to receive, and if a reception success flag is set to "true" at the preset time, the CPU 11 determines that it is not the timing to receive. The timing to receive is, in other words, the timing for correcting a time. If it is determined that it is the timing to receive (Yes in step S101), the processing proceeds to step S102. On the other hand, if it is determined that it is not the timing to receive (No in step S101), the processing proceeds to step S107.

In step S102, the CPU 11 sets any one of the standard radio wave reception success flag, the GPS satellite radio wave reception success flag, or the Bluetooth reception success flag to "false" in accordance with the timing to receive determined in step S101. In other words, the reception success flag is set to "false" at the timing to receive. After step S102, the process proceeds to step S103.

In step S103, the CPU 11 determines whether or not a standard radio wave, a GPS satellite radio wave, or a Bluetooth communication, for which timing to receive is determined in step S101, is successfully received. If it is determined that the receipt is successful (Yes in step S103), the processing proceeds to step S104. If it is determined that the receipt is not successful, namely fails (No in step S103), the processing proceeds to step S110.

In step S104, the CPU 11 sets a reception success flag to "true" for the standard radio wave, the GPS satellite radio wave, or the Bluetooth communication for which the receipt thereof is determined to be successful in step S103. The CPU 11 sets the reception success flag, which has been set to "false" in step S102, to "true". In step S105, the CPU 11 sets the YN hand counter. For example, the CPU 11 sets the YN hand counter to "24[h]", which represents 24 hours. The counter may be set to a value other than 24 hours, for example, 12 hours, 6 hours, or one week. In step S106, the CPU 11 starts the timer.

If it is determined that it is not the timing to receive in step S101 (No in step S101), the processing proceeds to step S107. In step S107, the CPU 11 determines whether or not the timer is operating. If the CPU 11 determines that the timer is operating (Yes in step S107), the processing proceeds to step S108. If the CPU 11 determines that the timer is not operating (No in step S107), the processing proceeds to step S111.

In step S108, the CPU 11 determines whether or not a predetermined period of time has elapsed based on the measurement of the timer which has been started in step S106, for example whether or not the measurement of the timer exceeds an hour. If the CPU 11 determines that the predetermined period of time has not elapsed (No in step S108), the processing proceeds to step S111. On the other hand, if the CPU 11 determines that the predetermined period of time has elapsed (Yes in step S108), the processing proceeds to step S109.

In step S109, the CPU 11 reduces the YN hand counter previously set in step S105. For example, if the measurement of the timer exceeds an hour, the YN hand counter is reduced from 24 [h] to 23[h].

On the other hand, if the CPU 11 determines that the receipt is not successful, namely fails in step S103 (No in step S103), the processing proceeds to step S110. In step S110, the CPU 11 sets the YN hand counter to "0". After step S110, the process proceeds to step S111.

After "No" in step S107, "No" in step S108, step S109, or step S110, the processing proceeds to step S111. In step S111, the CPU 11 determines whether or not the date has changed. Whether or not the date has changed may be determined based on a date and time measured by the clock circuit 16. If it is determined that the date has changed (Yes in step S111), the processing proceeds to step S112. In step S112, the CPU 11 sets all the reception success flags to "false". After step S112, the processing returns to step S101.

The setting of all the reception success flags (namely the standard time radio wave reception success flag, the GPS satellite radio wave reception success flag, and the Bluetooth reception success flag) to "false" when the date changes is done because a transmission status of radio waves, such as a standard radio wave, etc. is generally good at midnight, as is the reception environment. In other words, setting all the reception success flags to "false" when the date changes allows the CPU 11 to securely determine timing for receiving a radio wave, etc. in step S101 performed at midnight after the date changes, in which timing for receiving is determined.

In step S111 on the other hand, if it is determined that the date has not changed (No in step S111), the processing returns to step S101.

Figure 4:
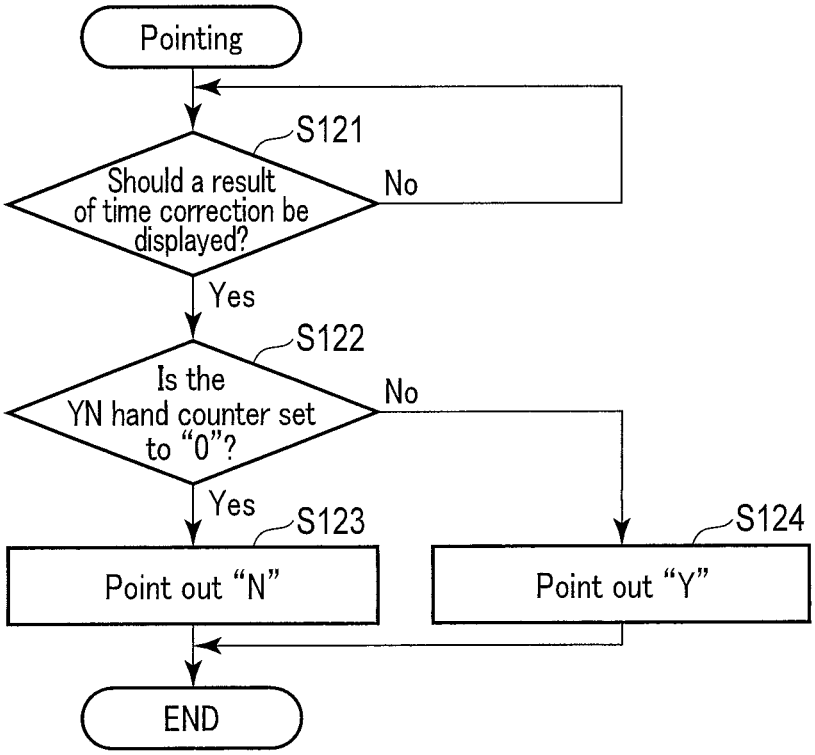
FIG. 4 is a flow chart showing an example of processing performed when a result of the time correction is presented in the timepiece of the embodiment.

FIG. 4 is a flow chart showing an example of processing to show a result of the time correction in the timepiece 1 of the present embodiment.

In step S121, the CPU 11 determines whether or not a result of correction of time should be presented. For example, by the user's pressing of any press button switch to which the function of inputting an operation to show a result of time correction is allocated, an operating signal to show a result of time correction is generated, and output to the CPU 11. If it is determined that a result of time correction is presented (Yes in step S121), the processing proceeds to step S122.

In step S122, the CPU 11 determines whether or not the YN hand counter is 0. If it is determined that the YN hand counter is 0 (Yes in step S122), the processing proceeds to step S123. In step S123, the CPU 11 causes the second hand 4 to point "N". In other words, to show that the immediately preceding receipt of radio wave fails and time correction was not performed, the second hand 4 points "NO" for a few seconds, for example. On the other hand, if it is determined that the YN hand counter is not "0" (No in step S122), the processing proceeds to step S124. In step S124, the CPU 11 causes the second hand to point "Y". In other words, to show that the immediately preceding receipt of radio wave is successful and correction of time was performed, the second hand 4 points "YES" for a few seconds, for example. After step S123 or step S124, the pointing process is finished.

In the present embodiment, a flag (the YN hand counter) differing from the reception success flag that is set to "false" at zero hour every day, in other words, when a date changes, is prepared. For example, suppose the flag has been kept as "true" for a predetermined period of time, for example 24 hours, since the last successful receipt of time. By doing so, successful time correction within the past 24 hours can be presented to the user, even if the presentation is made after zero hour; in other words, it can be presented to the user that the time displayed by the timepiece 1 is a time with fewer errors.

Thus, the CPU 11 controls, as a control unit, the operation of changing a current time based on a first flag (reception success flag) indicating whether or not the satellite radio reception processor 20, the communication circuit 40, or the low frequency wave receiver 50 successfully receives time information, and controls the operation of presenting to a user whether or not the changing operation has been performed (for example, causing the second hand 4 to point the first indicator 5 or the second indicator 6) based on a second flag indicating whether or not the changing operation is successful within a predetermined period of time (in other words, whether or not the YN hand counter is 0).

In the present embodiment, through the provision of a new flag differing from the reception success flag and based on the YN hand counter and the timer, it is possible to present to a user, with high reliability, the fact that the timepiece 1 indicates an accurate time, even after the date changes. It is thereby possible to improve user satisfaction.

Furthermore, in the present embodiment, processing relating to the YN hand counter is incorporated into existing internal processing relating to the reception success flags. For this reason, there is almost no need to change the conventional processing. Neither does the processing become complicated.

An example in which a second hand of an analog timepiece displays a result of time correction has been described in the above; however, a result of time correction may be displayed by a hand other than a second hand. A result of time correction may be displayed by a digital display, etc.

The present embodiment guarantees accuracy of a time within a predetermined period of time, for example 24 hours, in the display of a time correction result. Furthermore, the accuracy can be improved through the use of the location information of the portable terminal 100, such as a smart phone or a tablet device.

Hereinafter, a modification of the present embodiment will be described. In the present modification, a time within a predetermined period of time is made accurate through the use of location information of a timepiece obtained from a portable terminal 100, for example a smart phone. It is assumed that the portable terminal 100 is held by a user who wears the timepiece 1. For this reason, the accuracy in the presentation of a time correction result in the timepiece 1 can be improved through the use of location information obtained from the portable terminal 100. The present modification is effective especially when a user moves between different time zones, or is on the move such that he or she encounters a change of the daylight saving time (DST) rule, such that occurs during overseas travel.

Figure 5:
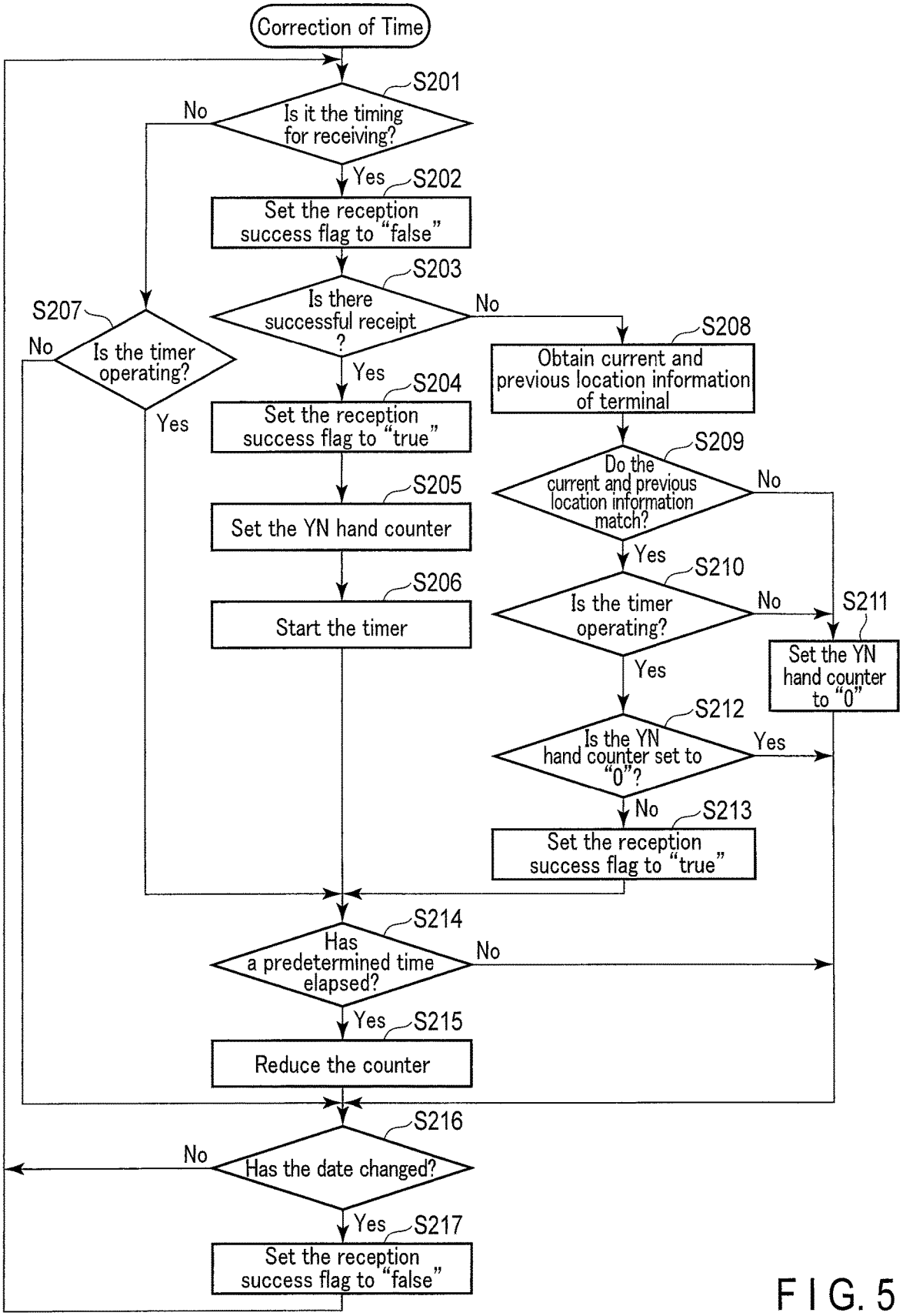
FIG. 5 is a flow chart showing an example of internal processing performed when a time is corrected in the timepiece of the embodiment.

FIG. 5 is a flow chart showing an example of internal processing for time correction in the timepiece 1 of the present modification.

In step S201, the CPU 11 determines whether or not it is the timing to receive. Herein, the timing to receive is the timing for receiving a Bluetooth communication from the portable terminal 100. In other words, the timing to receive is the timing for correcting a time. Whether or not it is the timing to receive is determined based on a preset time, and whether or not a reception success flag is set at the preset time. For example, if a reception success flag is not set to "true" at the preset time, the CPU 11 determines that it is timing to receive, and if a reception success flag is not set to "true" at the preset time, the CPU 11 determines that it is not timing to receive. If it is determined that it is timing to receive (Yes in step S201), the processing proceeds to step S202. On the other hand, if the CPU 11 determines that it is not timing to receive (No in step S201), the processing proceeds to step S207.

In step S202, the CPU 11 sets the Bluetooth reception success flag to "false" in accordance with the timing to receive determined in step S201. After this step S202, the process proceeds to step S203.

In step S203, the CPU 11 determines whether or not the Bluetooth communication is successfully received, for which timing to receive has been determined in step S201. If it is determined that the receipt is successful (Yes in step S203), the processing proceeds to step S204. If it is determined that the receipt is not successful, namely fails (No in step S203), the processing proceeds to step S208.

In step S204, the CPU 11 sets the reception success flag to "true" for the Bluetooth communication for which the receipt thereof has been determined to be successful in step S203. Herein, the CPU 11 causes, for example, the RAM 13 of the timepiece 1 to store the location information of the portable terminal 100 obtained at the time of the successful receipt. The location information of the portable terminal 100 may be, for example, obtained in step S204 and stored in the RAM 13 as location information obtained at the time of the latest successful receipt.

In step S205, the CPU 11 sets the YN hand counter. For example, "24 [h]" is set in the YN hand counter. In step S206, the CPU 11 starts the timer.

If it is determined that it is not timing to receive in step S201, the processing proceeds to step S207. In step S207, the CPU 11 determines whether or not the timer is operating. If it is determined that the timer is operating (Yes in step S207), the processing proceeds to step S214. If it is determined that the timer is not operating (No in step S207), the processing proceeds to step S216.

In step S203, if it is determined that the receipt is not successful, namely fails (No in step S203), the processing proceeds to step S208. In step S208, the CPU 11 obtains current and previous location information of the portable terminal 100. The current location information is obtained from the portable terminal 100 by the communication circuit 40. The CPU 11 obtains the previous location information of the portable terminal 100 from, for example, the location information stored in the RAM 13 at the time of the latest successful receipt.

In step S209, the CPU 11 determines whether or not the current location information of the terminal device 100 obtained in step S208 matches the previous location information of the terminal device 100 obtained in step S208. Herein, the matching therebetween is determined not based on the matching between the locations but based on time difference determined from the current and previous location information, or a difference in the DST rule. Even if these two pieces of location information are apart in terms of distance, if the locations are in the same time zone, or if the same DST rule is held in the locations, it may be determined that the current and previous location information match. On the other hand, even if the two pieces of location information are close in terms of distance, if the locations are in different time zones, or if different DST rules are adopted in the locations, it may be determined that the current and previous location information do not match. If it is determined that the pieces of location information match (Yes in step S209), the processing proceeds to step S210. If it is determined that the pieces of location information do not match (No in step S209), the processing proceeds to step S211.

In step S210, the CPU 11 determines whether or not the timer is operating. If the CPU 11 determines that the timer is not operating (No in step S210), the processing proceeds to step S211. If the CPU 11 determines that the timer is operating (Yes in step S210), the processing proceeds to step S212.

In step S211, the CPU 11 sets the YN hand counter to 0. In other words, if the receipt of the correction of time via a Bluetooth communication fails, and the current and previous location do not match, and if the timer is not operating even though the pieces of location information match, the YN hand counter is set to 0.

In step S212, the CPU 11 determines whether or not the YN hand counter is 0. If it is determined that the counter is not set to 0 (No in step S212), the processing proceeds to step S213. In step S213, the CPU 11 sets the reception success flag to "true". If it is determined that the counter is set to 0 (Yes in step S212), the processing proceeds to step S216.

After S206, "Yes" in step S207, or step S213, the processing proceeds to step S214. In step S214, the CPU 11 determines whether or not a predetermined period of time has elapsed based on the measurement of the timer which has been started since step S206, for example whether or not the measurement of the timer exceeds an hour. If it is determined that the predetermined period of time has not elapsed (No in step S214), the processing proceeds to step S216. On the other hand, if it is determined that the predetermined period of time has elapsed (Yes in step S214), the processing proceeds to step S215.

In step S215, the CPU 11 reduces the YN hand counter set at step S205. For example, if the measurement of the timer exceeds an hour, the YN hand counter is reduced from 24 [h] to 23 [h].

In step S216, the CPU 11 determines whether or not the date has changed. Whether or not the date has changed may be determined based on a date and time measured by the clock circuit 16. If it is determined that the date has changed (Yes in step S216), the processing proceeds to step S217. In step S217, the CPU 11 sets the reception success flag for a Bluetooth communication to "false". After step S217, the processing returns to step S201.

In step S216 on the other hand, if it is determined that the date has not changed (No in step S216), the processing returns to step S201.

Thus, in the present modification, if time information cannot be received from the portable terminal 100, conditional processing is performed based on location information of the portable terminal 100 that obtains the time information. For example, if a location at which receipt of time information is currently performed, namely current location information, is the same as a location of a latest successful receipt of time information, namely previous location information, the reception success flag is reset to "true" on the assumption that the time displayed by the timepiece 1 is not greatly wrong as long as 24 hours have not yet passed since the latest successful receipt, even if the current receipt of time information fails. On the other hand, in a case where the current location information differs from the previous location information, if the current receipt of time information fails, it may be possible that the locations are in different time zones or a different DST rule is adopted, because the location has been changed, even if 24 hours has not yet passed since the latest successful receipt of time information. Consequently, the reception success flag is left at "false" on the assumption that the time displayed by the timepiece 1 may be wrong.

According to the present modification, it is possible to manage time correction through acquisition of time correction information more accurately in conjunction with the portable terminal 100 held by a user who wears the timepiece 1. In the present modification, more accurate time correction information can be presented to a user through the management of correction of time in accordance with information of the user's actual location.

An example in which a Bluetooth communication takes place between the timepiece 1 and the portable terminal 100 has been described above; however, a wireless communication other than a Bluetooth communication may be possible. The communication circuit 40 of the timepiece 1 serves its function as long as it receives signals including time information through a wireless communication with an external device.

The location information used in the present modification is not limited to location information obtained by the portable terminal 100. For example, similar processing is also possible with the use of location information received via a GPS satellite radio wave. In other words, in the present modification, similarly to the foregoing embodiment, the timing to receive in step S201 is the timing to receive any of a standard radio wave, a GPS satellite radio wave, or a Bluetooth communication. The modification can be achieved as long as location information of the timepiece 1 at the time of successful receipt in step S204 can be obtained.

The present invention is not limited to the above-described embodiment, and can be modified in various manners in practice when implementing the invention without departing from the gist of the invention. Moreover, the embodiments can be suitably combined; in

The invention claimed is:

1. A timepiece comprising:

a clock circuit;

a signal receiver configured to receive a signal that includes time information; and a processor configured to:

perform a changing operation of attempting to receive the signal that includes the time information and changing a current time measured by the clock circuit based on the time information; and perform a presenting operation to indicate whether or not the changing operation is successful, wherein the processor is configured to:

set a first flag in response to the signal receiver successfully receiving the signal that includes the time information;

clear the first flag in response to a date of a current time counted by the clock circuit being changed;

set a second flag in response to the signal receiver successfully receiving the signal that includes the time information, where the second flag remains set even when the date of the current time counted by the clock circuit changes;

perform the changing operation based on the first flag being cleared; and perform the presenting operation within a predetermined period of time based on the second flag remaining set even when the date of the current time counted by the clock circuit changes.

2. The timepiece according to claim 1, wherein the processor is configured to:

set the first flag to "true" if the signal receiver successfully receives the time information, and to "false" when a date of a current time measured by the clock circuit changes; and set the second flag to "true" if the signal receiver successfully receives the time information, and to "false" if the signal receiver fails to receive the time information.

3. The timepiece according to claim 2, wherein the processor counts elapsed time since successful receipt of the time information, if the elapsed time is a predetermined value, the processor controls the presenting operation so as to present a fact that the changing operation has not been successful within a predetermined period of time, and if the elapsed time differs from the predetermined value, the processor controls the presenting operation so as to present a fact that the changing operation has been successful within a predetermined period of time.

4. The timepiece according to claim 3 further comprising:

a first indicator indicating that the time information is successfully obtained;

a second indicator indicating that the time information is not successfully obtained; and a hand configured to point at the first indicator or the second indicator under control of the processor, wherein the processor causes the hand to point at the first indicator if the elapsed time differs from a predetermined value, and causes the hand to point at the second indicator if the elapsed time is a predetermined value.

5. The timepiece according to claim 1, wherein the processor is configured to:

set the first flag to "true" if the signal receiver successfully receives the time information, and to "false" if a date of a current time measured by the clock circuit changes; and set the second flag to "true" if the signal receiver successfully receives the time information, and to "false" if the changing operation is not performed within a predetermined period of time.

6. The timepiece according to claim 5, wherein the processor counts elapsed time since successful receipt of the time information, if the elapsed time is a predetermined value, the processor controls the presenting operation so as to present a fact that the changing operation has not been successful within a predetermined period of time, and if the elapsed time differs from the predetermined value, the processor controls the presenting operation so as to present a fact that the changing operation has been successful within a predetermined period of time.

7. The timepiece according to claim 6, further comprising:

a first indicator indicating that the time information is successfully obtained;

a second indicator indicating that the time information is not successfully obtained; and a hand configured to point at the first indicator or the second indicator under control of the processor, wherein the processor causes the hand to point at the first indicator if the elapsed time differs from a predetermined value, and causes the hand to point at the second indicator if the elapsed time is a predetermined value.

8. The timepiece according to claim 1, wherein the processor counts elapsed time since successful receipt of the time information, if the elapsed time is a predetermined value, the processor controls the presenting operation so as to present a fact that the changing operation has not been successful within a predetermined period of time, and if the elapsed time differs from the predetermined value, the processor controls the presenting operation so as to present a fact that the changing operation is successful within a predetermined period of time.

9. The timepiece according to claim 8 further comprising:

a first indicator indicating that the time information is successfully obtained;

a second indicator indicating that the time information is not successfully obtained; and a hand configured to point at the first indicator or the second indicator under control of the processor, wherein the processor causes the hand to point at the first indicator if the elapsed time differs from a predetermined value, and causes the hand to point at the second indicator if the elapsed time is a predetermined value.

10. The timepiece according to claim 1, wherein the processor is configured to:

if the signal receiver successfully receives the time information, obtain a signal that includes location information at a time of the successful receipt, and cause a memory to store the location information as previous location information, if the signal receiver unsuccessfully receives the time information, obtain a signal that includes current location information, which is location information at a time of the unsuccessful receipt, compares the current location information with the previous location information, and if the current location information and the previous location information match and the second flag is set, set the first flag to "true".

11. The timepiece according to claim 10, wherein the processor sets the second flag to "false" if the current location information and the previous location information do not match.

12. A control method for a change of a time, comprising:

measuring a current time;

receiving a signal that includes time information;

performing a changing operation of attempting to receive the signal that includes the time information and changing the current time based on the time information; and performing a presenting operation to indicate whether or not the changing operation is successful, wherein the control method comprises:

setting a first flag in response to the signal receiver successfully receiving the signal that includes the time information;

clearing the first flag in response to a date of a current time counted by the clock circuit being changed;

setting a second flag in response to the signal receiver successfully receiving the signal that includes the time information, where the second flag remains set even when the date of the current time counted by the clock circuit changes;

performing the changing operation based on the first flag being cleared; and performing the presenting operation within a predetermined period of time based on the second flag remaining set even when the date of the current time counted by the clock circuit changes.

13. A non-transitory storage medium storing thereon a program readable by a computer incorporated into a timepiece, the timepiece comprising a clock circuit and a signal receiver configured to receive a signal including time information, the program causing the computer to:

perform a changing operation of attempting to receive the signal that includes the time information and changing a current time measured by the clock circuit based on the time information; and perform a presenting operation to indicate whether or not the change operation is successful, wherein the program causes the computer to:

set a first flag in response to the signal receiver successfully receiving the signal that includes the time information;

clear the first flag in response to a date of a current time counted by the clock circuit being changed;

set a second flag in response to the signal receiver successfully receiving the signal that includes the time information, where the second flag remains set even when the date of the current time counted by the clock circuit changes;

perform the changing operation based on the first flag being cleared; and perform the presenting operation within a predetermined period of time based on the second flag remaining set even when the date of the current time counted by the clock circuit changes.

* * * * *